United States Patent [19]

Tamura

[11] Patent Number: 4,758,810

[45] Date of Patent: Jul. 19, 1988

[54] DEFLECTING YOKE

[75] Inventor: Manabu Tamura, Nagasaki, Japan

[73] Assignee: Mitsubishi Denki Kabushiki Kaisha, Tokyo, Japan

[21] Appl. No.: 38,100

[22] Filed: Apr. 14, 1987

[30] Foreign Application Priority Data

May 14, 1986 [JP] Japan ..... 61-108660

[51] Int. Cl.[4] ..... H01F 7/00

[52] U.S. Cl. ..... 335/210; 335/213

[58] Field of Search ..... 335/210, 211, 213, 214, 335/301

[56] References Cited

U.S. PATENT DOCUMENTS

| | | | |
|---|---|---|---|
| 3,573,525 | 4/1971 | Fuse | 335/210 X |
| 3,689,860 | 9/1972 | Bauzhis et al. | 335/210 |
| 4,257,024 | 3/1981 | Shimoma et al. | 335/210 X |

FOREIGN PATENT DOCUMENTS

| | | | |
|---|---|---|---|
| 52-126105 | 5/1979 | Japan | 335/212 |
| 57-176057 | 6/1981 | Japan | 335/210 |
| 59-31088 | 9/1984 | Japan | 335/210 |

*Primary Examiner*—George Harris

*Attorney, Agent, or Firm*—Armstrong, Nikaido, Marmelstein & Kubovcik

[57] ABSTRACT

This invention relates to improvements of a deflecting yoke for deflecting an electron beam electromagnetically when a high energy electron beam is used in a cathode ray tube.

The deflecting yoke is constructed by adding additional coils to a conventional deflecting yoke having an annular core in substantially cylindrical shape, opposite vertical coils which are wound directly around the annular core, and a pair of horizontal coils which are disposed substantially horizontally along the inner circumferential surface of the annular core.

4 Claims, 4 Drawing Sheets

DEFLECTING YOKE

BACKGROUND OF THE INVENTION

The present invention relates to improvements in a deflection yoke for deflecting an electron beam electromagnetically when a high energy electron beam is used in a cathode ray tube (referred to as CRT hereafter).

FIGS. 7 through 9 are rear elevations showing a prior art yoke seen from the rear of the CRT. An annular core 1 substantially cylindrical in shape surrounds an electron-gun portion at the rear of the CRT and is mounted around an outer circumference of a small-diameter portion of the CRT.

A pair of horizontal coils 2 and 3 are first coils disposed substantially horizontally along the inner circumferential surface of the annular core 1.

Vertical coils 4 and 5 are second coils formed by a conductor wire wound directly around the core 1 in a so-called "torodial-winding" using a special coil-winding machine (not shown diagrammatically).

The operation of a deflection yoke in the above arrangement is described as follows:

A horizontal magnetic flux 6 is generated by coils 2 and 3 in a direction of solid arrows as shown in FIG. 7 and a vertical magnetic flux 7 is generated by vertical coils 4 and 5 in the direction of the solid arrows as shown in FIG. 8. A magnetic field having the flux oriented in these two directions is set up in such a way that the annular core is positioned at a center of the magnetic field.

The magnetic field intensity of the horizontal magnetic flux 6 and vertical magnetic flux 7 vary in response to the amount of current through the horizontal coils 2 and 3 and the vertical coils 4 and 5, respectively. The directions of the flux alternate from the directions in solid arrows 6 and 7 to the directions in dotted arrows 6' and 7', respectively in response to the direction of the current.

The direction of an electron beam passing through the small-diameter portion of the CRT which is inserted into the annular core is deflected by the magnetic field and an image is displayed brightly on the CRT.

Since the horizontal magnetic flux 6 passes through two semi-circular magnetic paths passing through the annular core 1 as shown in FIG. 9, it causes opposing magnetic poles 1*a* and 1*b* to set up at the upper part and the lower part of the annular core 1 respectively.

The polarities of these magnetic poles change from N to S and back to N in alternating fashion and therefore an alternating magnetic field is formed in such a way that the annular core 1 is positioned at a center of the alternating magnetic field. A leakage flux 8 which is emitted from the yoke outwardly is produced between the poles 1*a* and 1*b*.

SUMMARY OF THE INVENTION

Since the prior art deflecting yoke is configured as mentioned above, the leakage flux 8 emitted from the yoke may interfere with radio wave equipment such as radio receivers.

A variety of electromagnetic shielding constructions such as magnetic shield designs are necessitated to solve this kind of problem. However, the shielding constructions cause a variety of problems such as a rise in the temperature in the CRT display equipment, deteriorated performance due to the temperature, poor durability and a shortened life time, and rise in manufacturing cost of the equipment.

The present invention is to solve the above-mentioned problems and its object is to provide, by only adding a simple improvement to a prior art yoke, a deflection yoke which is prevented from causing the electromagnetic interference while maintaining long life and low cost of the CRT without a significance rise in temperature.

The deflection yoke according to the present invention is of a type that additional third coils (referred to as "magnet shield coil" hereafter) are wound around the core in order to cancel out the flux generated in a direction extending outwardly from the core.

The deflection yoke according to the present invention works in such a way that the magnetic flux produced within a magnetic core is cancelled out by the opposing flux which is set up by the current flowing through the magnet shield coils so that no opposing magnetic poles are set up within the core. Therefore, it is possible to thoroughly solve the problem of leakage flux emitted outside the magnetic core from opposing magnetic poles.

DETAILED DESCRIPTION OF THE EMBODIMENTS

Figure 1:
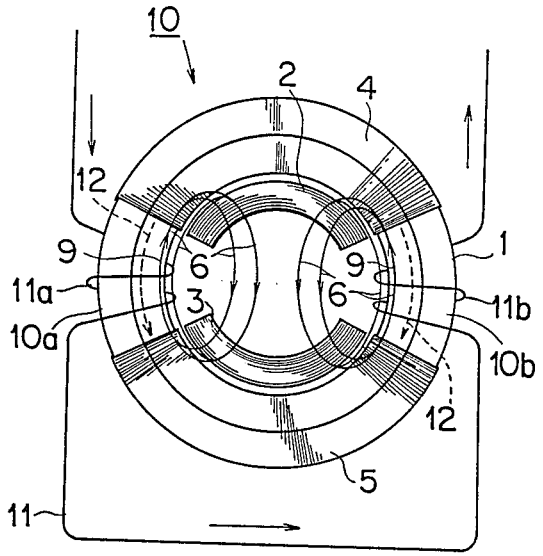
FIGS. 1, 2 and 3 are a rear elevation, a side elevation and a perspective view of a deflection yoke according to one embodiment of the present invention.

A preferred embodiment of the present invention will be described with reference to the accompanying drawings. In FIGS. 1 through 10, like parts or components are denoted by like reference numerals throughout.

Figure 2:
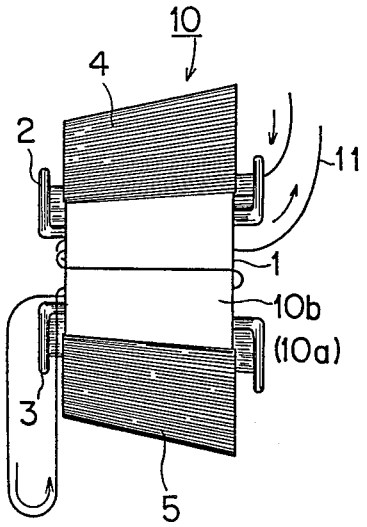
Figure 3:
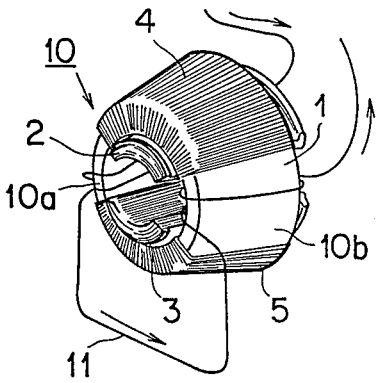
Figure 4:
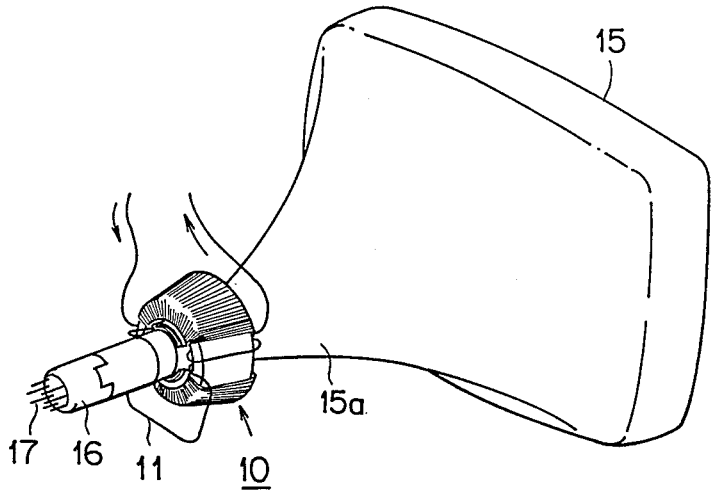
FIG. 4 is a perspective view of the yoke in FIG. 1 through FIG. 3, mounted on a CRT.

In FIGS. 1 through 3, a magnetic flux 9 is generated by horizontal coils 2 and 3 within an annular core 1 used as a magnetic core.

Magnet shield coils 11*a* and 11*b* formed of conductive wire 11 are around non wire-wound portions 10*a* and 10*b* of a deflecting yoke 10 and are electrically connected in series with each other.

A magnetic flux 12 is generated by the magnet shield coils 11*a* and 11*b* within the annular core 1.

The yoke 10 constructed as mentioned above is mounted on a small-diameter portion 15*a* at the rear of a CRT 15. An electron gun 16 is connected to the portion 15*a* of the CRT and a plurality of connecting pins 17 protrude rearwardly from the electron gun 16.

The operation of the yoke described above is as follows:

When a current flows through vertical coils 4 and 5 which are conductive wires wound directly around the annular core 1 in so-called "toroidal-winding" and through horizontal coils 2 and 3 which are disposed along a circumferential inner surface of the annular core 1, horizontal flux and the vertical flux are generated respectively and the horizontal flux will set up the magnetic field indicated by an arrow 6 as shown in FIG. 1.

Simultaneously, a magnetic flux 9 is set up within the non wire-wound portions 10*a* and 10*b* of the annular core 1.

In the prior art, there used to be a drawback in that leakage flux resulted from the magnetic flux 9. However, in this embodiment of the present invention, the magnet shield coils 11*a* and 11*b* are wound around the non wire-wound portions 10*a* and 10*b* and the magnet shield coils 11*a* and 11*b* produce an opposing magnetic flux 12 (shown by dotted arrows in FIG. 1) which opposes the flux 9 within the annular core 1 to cancel out the magnetic flux 9. Therefore, magnetic poles produced within the annular core 1 are avoided and the leakage of magnetic flux is reduced or extinguished.

Figure 5:
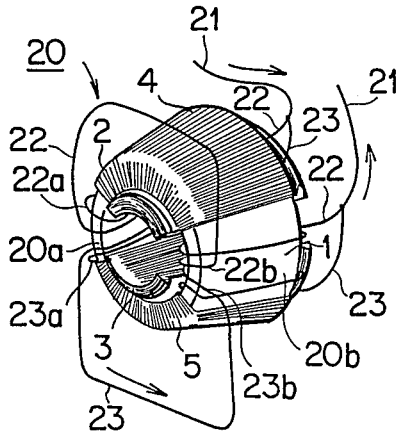
FIGS. 5 and 6 are a perspective view and a rear elevation of a yoke of another embodiment according to the present invention.
Figure 6:
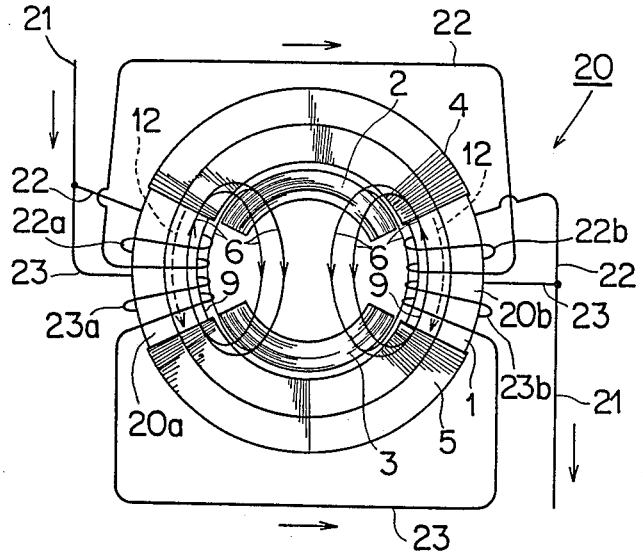
Figure 7:
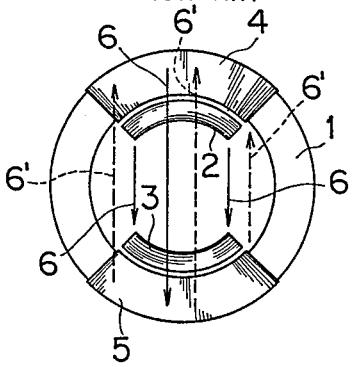
FIG. 7 PRIOR ART
FIGS. 7 through 9 are rear elevations of yokes according to the prior art.
Figure 8:
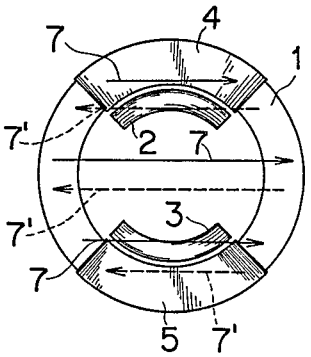
FIG. 8 PRIOR ART
Figure 9:
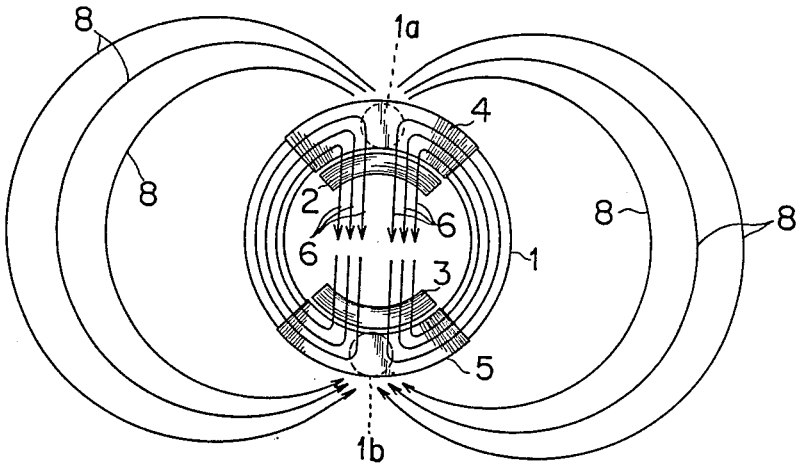
FIG. 9 PRIOR ART

Though the above-mentioned embodiment shows an example in which the magnet shield coils 11*a* and 11*b* are electrically connected in series with each other, the invention can also be embodied, without being restricted to such series-connected circuit, by a parallel-connected circuit in which magnet shield coils 22*a*, 23*a*, 22*b* and 23*b* are wound around non wire-wound portions 20*a* and 20*b* of the annular core 1 of a deflection core 20. The magnet shield coils are formed by each of two parallel wires 22 and 23 branching off a wire 21 as shown in FIGS. 5 and 6. The opposing magnetic flux 12 cancels out the magnetic flux 9 within the annular core 1. The embodiment in the parallel-connected circuit also gives the same effect as the embodiment in the seriesconnected circuit described above.

Figure 10:
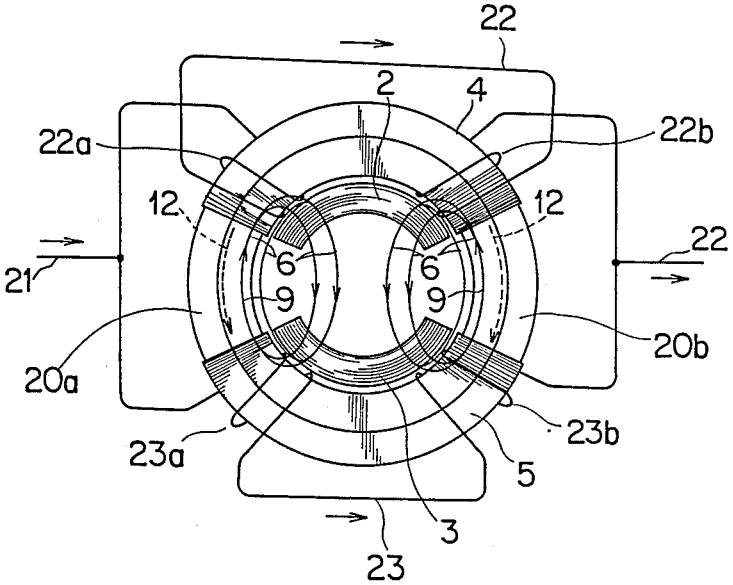
FIG. 10 is a rear elevation of still another embodiment according to the present invention.

Further, the same effect can also be obtained by winding the magnet shield coils not around the non wire-wound portions 20*a* and 20*b* but over the vertical coils 4 and 5 as shown in FIG. 10. Arrows without reference numerals in each figure show the direction of the current flowing through each wire.

According to the present invention, because the magnetic flux having its poles within the magnetic core is cancelled out by the opposing magnetic flux set up by the magnet shield coils, it is possible to eliminate radio interference to radio wave equipment without employing a large-scale magnet shield design and to avoid the rise in the temperature of the CRT or the entire pice of equipment which would be caused if a large-scale electromagnetic shielding construction were employed, while maintaining long life and low cost of the CRT equipment.

I claim:

1. A deflection yoke for deflecting an electron beam in a CRT, said deflection yoke comprising:

(a) an annular magnetic core;

(b) a pair of first coil means disposed along diametrically opposite inner circumferential surfaces of said core, said first coil means generating a magnetic flux in a first direction;

(c) a pair of second coil means wound around diametrically opposing portions of said core, said second coil means generating a magnetic flux in a second direction perpendicular to said first direction; and (d) third coil means wound around portions of said core, said third core means generating a magnetic flux opposite to the leakage flux generated by said first coil means, thereby cancelling said leakage flux generated by said first coil means.

2. A deflection yoke as set forth in claim 1, wherein said third coils means comprises a pair of coils wound on portions of said core different from the portions of said core where said second coil means are wound.

3. A deflection yoke as set forth in claim 1, wherein said third coil means comprises a pair of coils connected electrically in series.

4. A deflection yoke as set forth in claim 1, wherein said third coil means comprises a pair of coils connected electrically in parallel, one of said pair of coils having first and second portions wound on opposite sides of said core and the other of said pair of coils having third and fourth portions wound on opposite sides of said core.

* * * * *